United States Patent [19]

Ebbert et al.

[11] 3,985,307

[45] Oct. 12, 1976

[54] MECHANICAL DEVICE TO MIX AMALGAM

[75] Inventors: Robert Ebbert, Rochester; Harold H. Simpson, Fraser, both of Mich.

[73] Assignee: Sybron Corporation, Rochester, N.Y.

[22] Filed: June 9, 1975

[21] Appl. No.: 584,745

[52] U.S. Cl. ..... 241/284; 241/199.5; 259/72; 259/DIG. 20

[51] Int. Cl.[2] ..... B02C 17/08

[58] Field of Search ..... 241/176, 177, 199.1, 241/199.5, 199.6, 284; 259/72, DIG. 20

[56] References Cited

UNITED STATES PATENTS

| | | | |
|---|---|---|---|
| 2,175,321 | 10/1939 | Saffir | 241/176 X |
| 3,170,648 | 2/1965 | McShirley | 241/284 |
| 3,602,443 | 8/1971 | McShirley | 241/284 X |
| 3,679,184 | 7/1972 | Woodham | 259/72 |

*Primary Examiner*—Granville Y. Custer, Jr.
*Assistant Examiner*—Howard N. Goldberg
*Attorney, Agent, or Firm*—Theodore B. Roessel; Roger Aceto

[57] ABSTRACT

A dental amalgam producing machine having a rotatable arm adapted to receive an amalgam mulling container at one end and having a counter weight at the other end, the arm being inclined with respect to the horizontal. A belt disposed about a non-rotating pulley is also looped about the container to hold the container on the arm against centrifugal force and to spin it on its own axis as the container is carried about the arm axis of rotation. Centrifugal force alone holds the cup on to the arm and no other mechanical locks or restraints are needed.

7 Claims, 4 Drawing Figures

MECHANICAL DEVICE TO MIX AMALGAM

BACKGROUND OF THE INVENTION

The present invention relates generally to dental amalgam producing machines and more particularly to such a machine in which the amalgam ingredients are placed in a mulling cup and the cup spun or otherwise agitated to mix the amalgam ingredients.

There are generally two types of amalgam producing machines. In one type, premeasured amounts of the amalgam ingredients are placed in capsules. The dentist, then, merely locks the capsule in place on the machine which then subjects the capsule to very rapid reciprocating motion. A typical machine of this type is illustrated in U.S. Pat. No. 3,602,443.

In another type of machine, the amalgam ingredients are placed in an open cup which is located at one end of a rotating armature. A gear train in the machine then spins the cup while rotating the armature so that the cup spins on its own axis while orbiting the axis of rotation of the armature. Such a machine is illustrated for example in U.S. Pat. No. 3,170,648. The present invention pertains to an improvement in the operation and construction of this latter type of amalgam producing machine.

Because the cup is spun on its axis while orbiting about another point, the apparatus of the prior art usually employed some sort of gear train to develop the desired motion. Also, the spinning cup was restrained on the end of the rotating arm against centrifugal force. This was usually accomplished by a clamp or other mechanical lock. Another method was to provide the cup with an axle which in turn was inserted into a suitable receiver on the end of the rotating arm. A further requirement in this type of apparatus was that the cup have a cover or lid to prevent the amalgam ingredients from riding up and over the walls of the container under the influence of centrifugal force.

Various problems of the prior art, such as care and maintenance of the gear train, special locking or container receiving fixtures and specially configured containers are all eliminated in the present invention. In this respect, the present invention provides a device wherein a loose belt and centrifugal force act to both hold the container on one end of a rotating arm while spinning the container about its own axis. When the arm is not rotating, the container is unrestrained and free to be removed for convenient filling or emptying. Also, the arm is tipped slightly with respect to horizontal so that the axis of the container is tipped from the vertical. With this arrangement, the container can be open and need not have any cover or lid to prevent the spilling over of the ingredients under the influence of centrifugal force.

SUMMARY OF THE INVENTION

The present invention may be characterized in one aspect thereof by the provision of an arm disposed in a plane making an acute angle with the horizontal, the arm being rotatable about an upright axis and having a mulling cup receiving portion at one end including a live roller; a pulley coaxially carried by the arm, the pulley being fixed against rotation but being rockable about its axis so as to remain oriented generally in a plane parallel to the plane of the arm as the arm rotates; and an endless belt about the pulley and disposable about a mulling cup located at the cup receiving portion of the arm, the rotation of the arm carrying the cup in oribit about the arm axis of rotation while the belt restrains the cup on the arm against centrifugal force and causes the cup to spin on its own axis.

OBJECTS OF THE INVENTION

One object of the present invention is to provide a dental amalgam producing machine wherein the mulling cup is restrained against centrifugal force when the machine is rotating and is unrestrained and freely movable from the machine when the machine is not operating.

Another object of the present invention is to provide an amalgam producing machine in which the amalgam cup need not have a cover in order to prevent ingredients from spilling over the edge of the cup due to centrifugal force.

A further object is to provide an amalgam producing maching which uses no gear train to orbit and spin the mulling container.

A still further object of the present invention is to provide an amalgam producing maching having a rotating arm which makes an acute angle with the horizontal so that a mulling cup on one end of the arm is pressed against the arm by centrifugal force as the arm spins.

These and other objects, advantages and characterizing features of the present invention will become more apparent upon consideration of the following detailed description thereof when taken in connection with the accompanying drawings depicting the same.

DESCRIPTION OF THE PREFERRED EMBODIMENTS

Figure 1:
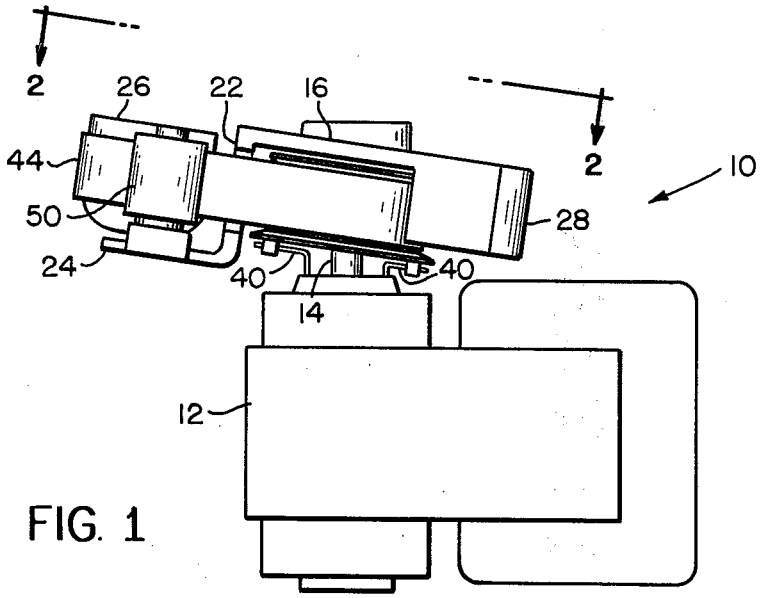
FIG. 1 is a side elevation view of the amalgam producing machine.

Referring to the drawings, FIG. 1 shows an amalgam producing machine generally indicated at 10 including an electric motor 12, a shaft 14 driven by the motor and a rotating armature 16 fixed to the shaft. As shown in the FIG., the armature is inclined with respect to the horizontal for purposes set out hereinbelow, the inclination being approximately 8° from the horizontal.

Figure 3:
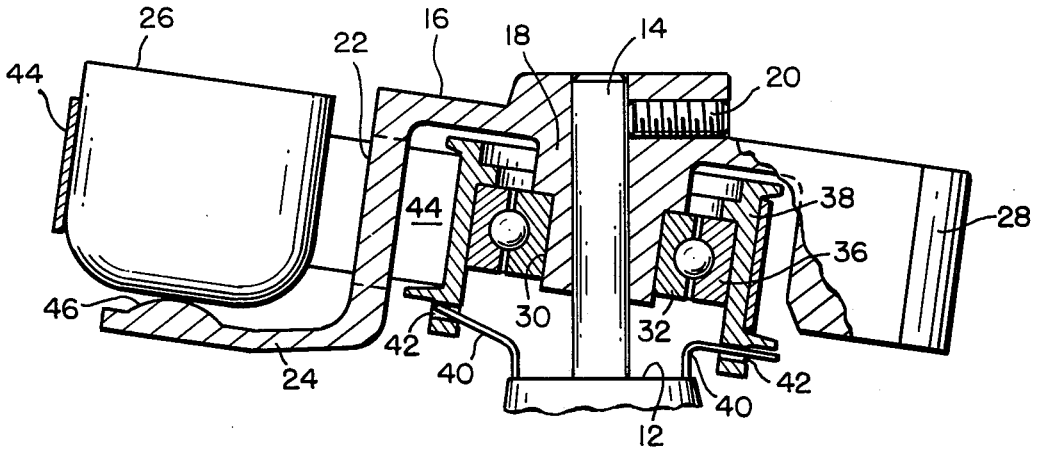
FIG. 3 is a elevation view of the armature of FIG. 2 partly broken away and in section.

Referring to FIG. 3, armature 16 is shown to include a central hub portion 18 which is fixed to the motor shaft 14 by a set screw 20 or other suitable means. Spaced from the hub on one side of the arm is a depending portion 22 which includes an outwardly extending flange 24 adapted to receive a mulling cup 26 in which the amalgam ingredients are placed for mixing. Flange 24 is inclined with respect to the horizontal as is the armature.

To counterbalance armature 16 it is provided with a counter weight 28 spaced from the hub on the other side thereof from depending portion 22.

Hub 18 has its outer surface 30 inclined slightly from the vertical so as to lie generally normal to the plane of the amature and flange. The outer surfce of the hub carries the inner race 32 of a ball bearing. The outer race 36 of the ball bearing carries a pulley 38. With this arrangement, then, the orientation of pulley 38 is such that it lies in a plane generally parallel to the plane of amature 16 and flange 24.

The pulley, however, is fixed against rotation by any suitable flexible means. For example, as shown in FIG. 3, this means takes the form of a pair of bent wires 40 which are fixed at one end to a portion of motor 12 and which have their other end passing through openings 42 in the flange of the pulley.

Disposed about the pulley is an endless belt 44. The belt passes on either side of depending portion 22 (FIG. 2) so that it may be positioned about mulling cup 26 located on flange 24. Completing the structure of the amalgam producing machine is a rounded projection 46 on flange 24 (FIGS. 3 and 4) which provides point support for the mulling cup beneath its axis of rotation and an upstanding roller member 50 (FIGS. 1 and 2) journeled to the flange adjacent its trailing edge 48 (considering that the direction of rotation is clockwise as viewed in FIG. 2) for purposes set out hereinbelow.

In operation, the amalgam ingredients are placed into mulling cup 26 and the cup simply located on projection 46 and within endless belt 44. The machine is then started with the rotation of the armature being clockwise as viewed in FIG. 2. Centrifugal force tends to throw the mulling cup radially outward, but such movement is restrained by belt 44. Further, ineria brings the mulling cup back against roller 50 which is located so as to center the cup on projection 46. In this respect, the distance between the projection and roller 50 should approximately equal the radius of the mulling cup.

Figure 2:
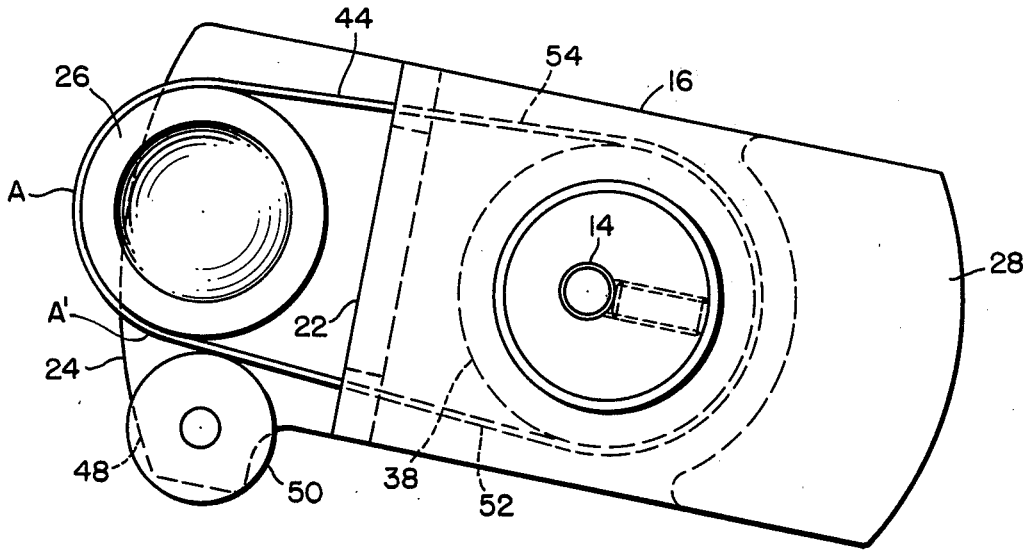
FIG. 2 is a view of the amature on an enlarged scale taken along lines 2—2 of FIG. 1.

As set out hereinabove, pulley 38 does not rotate. Accordingly, as the armature moves clockwise as viewed in FIG. 2, belt 44 being disposed about mulling cup 24 is also carried clockwise. However, since pulley 38 does not rotate, one side 52 of the belt tends to wrap about the pulley while the other side 54 tends to unwrap from the pulley. The result is any given point on the belt moves counterclockwise about the pulley. For example, as shown in FIG. 2, point A on the belt moves to approximately A′ when the armature has rotated clockwise about 90° from the position shown in FIG. 2. Further, while the armature is rotating, centrifugal force pushes the cup against the belt so that the resulting friction between the belt and cup causes the cup to spin counterclockwise on its own axis as the armature moves the cup in a clockwise direction. As set out hereinabove roller 50 is journaled to the trailing edge 48 of the flange. As the amature spins, the inertia of the cup tends to force it back against the roller. This tends to squeeze the belt between the cup and roller. Having the roller journaled permits the belt to move across the roller whereas a fixed roller would tend to hinder such movement. Thus, the net movement is that the mulling cup is spun on its own axis while it is being orbited by the armature about shaft 14. This combination of movements together with the conventional internal fluted configuration (not shown) of the cup causes the mulling together of the ingredients within the cup to produce the dental amalgam.

Since the armature is inclined with respect to the horizontal, a component of the centrifugal force created tends to hold the mulling cup in contact with the rounded projection 46 which in turn provides a substantially point contact to facilitate the spinning of the cup. Further, with this arrangement the axis of the mulling cup is inclined toward the vertical. This helps to prevent the contents of the mulling cup from riding up the side and spilling over the edge of the cup under the influence of centrifugal force.

Figure 4:
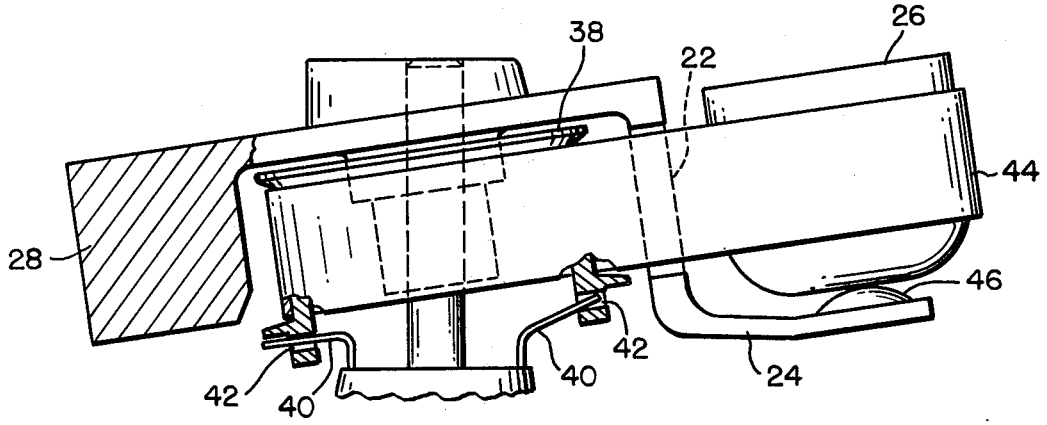
FIG. 4 shows the armature of FIG. 3 rotated 180°.

Because the armature is inclined with respect to the horizontal, the general orientation of the armature changes from that shown in FIG. 3 to that shown in FIG. 4. The orientation of pulley 38 must also move generally from that shown in FIG. 3 that shown in FIG. 4. This change in orientation is permitted by the flexible wires 40 which let the pulley rock back and forth towards and away from the vertical while preventing the pulley from rotating. In this way, the plane of the pulley remains generally parallel to the plane of the armature as the armature rotates.

Thus, it should be appreciated that the present invention accomplishes its intended objects in providing a dental amalgam producing machine having a minimum of moving parts and which eliminates the need for any clamp or other like member to restrain the mulling cup on the machine. The machine of the present invention also produces the spinning and orbital motions needed for the mulling of the amalgam ingredients without the use of gear trains or the like. Further, since the axis of the mulling cup on the machine is inclined toward the vertical, the spilling out of ingredients due to centrifugal force is prevented and the mulling cup need not have any cover or lid for this purpose.

Having thus described the invention in detail, what is claimed as new is:

1. An amalgam producing machine comprising:

a. an armature disposed in a plane making an acute angle with the horizontal and rotatable about an upright axis, said armature having a mulling cup receiving portion at one end;

b. a motor for rotating said armature;

c. a pulley coaxially journaled to said armature and fixed against rotation said pulley being disposed beneath said armature and in a plane generally parallel to the plane of said armature;

d. an endless belt disposed about said pulley and extending to said receiving portion for placement about a mulling cup located at said portion; and e. an upright roller journaled to said armature at said receiving portion providing positioning means for said mulling cup.

2. An amalgam producing machine as in claim 1 wherein said receiving portion includes:

a. a rounded projection providing substantially point support for a mulling cup located at said receiving portion; and b. said upright roller being journaled adjacent the edge of said armature which trails the direction of rotation, said roller being disposed so as to substantially center the axis of a mulling cup on said rounded projection with said belt passing between said upright roller and a mulling cup at said receiving portion.

3. A amalgam producing machine as in claim 1 wherein said armature has a hub portion fixed to the rotating shaft of said motor, the outer surface of said hub being inclined from the vertical and said pulley being journaled to said hub portion.

4. An amalgam producing machine as in claim 1 including flexible means fixing said pulley to the body of said motor to permit a rocking motion of said pulley in a vertical plane while preventing the rotation of said pulley.

5. An amalgam producing machine comprising:

a. a drive motor having a shaft rotatable about an upright axis;

b. an arm fixed to said shaft;

c. a mulling cup receiving portion at one end of said arm;

d. a pulley journaled with respect to said arm and being fixed against rotation;

e. an endless belt disposed about said pulley and extending to said receiving portion for placement about and in contact with a mulling cup at said portion, said belt, when said arm is rotating, being means to restrain the mulling cup against centrifugal force while spinning the cup on its own axis in a direction opposite to the direction of rotation, said belt otherwise not restraining the mulling cup when the arm is not rotating; and f. an upright roller journaled to said arm at said receiving portion, said roller being positioned so that its outer periphery will provide the means to properly locate a mulling cup at said receiving portion when said arm is rotating and not otherwise restraining the mulling cup when said arm is not rotating said roller and cup at said receiving portion engaging said belt therebetween when said arm is rotating.

6. An amalgam producing machine as in claim 5 wherein said mulling cup receiving portion comprises:

a. a member depending from said arm;

b. flange extending outwardly from said depending member;

c. a rounded projection on said flange providing substantially point support for a mulling cup; and d. said roller being journaled adjacent an edge of said flange trailing the direction of rotation, the outer periphery of said roller being spaced from said projection a distance substantially equal to the radius of a mulling cup so as to locate the axis of the cup over said projection.

7. An amalgam producing machine as in claim 6 wherein said arm and flange are in a plane making an acute angle with respect to the horizontal, the axis of rotation of a mulling cup at said receiving portion being displaced toward the vertical by a similar angle whereby a component of centrifugal force will act to hold the cup against said projection.

* * * * *